US010016672B2

(12) United States Patent
Mouyade

(10) Patent No.: US 10,016,672 B2
(45) Date of Patent: Jul. 10, 2018

(54) SELF-LOCKING BINDING FOR TELEMARK SKI, TOURING SKI OR CROSS-COUNTRY SKI

(71) Applicant: Pierre Mouyade, Peypin (FR)

(72) Inventor: Pierre Mouyade, Peypin (FR)

( * ) Notice: Subject to any disclaimer, the term of this patent is extended or adjusted under 35 U.S.C. 154(b) by 0 days.

(21) Appl. No.: 15/112,244

(22) PCT Filed: Jan. 26, 2015

(86) PCT No.: PCT/FR2015/050171

§ 371 (c)(1),
(2) Date: Jul. 18, 2016

(87) PCT Pub. No.: WO2015/110768

PCT Pub. Date: Jul. 30, 2015

(65) Prior Publication Data

US 2016/0346664 A1 Dec. 1, 2016

(30) Foreign Application Priority Data

Jan. 24, 2014 (FR) ..... 14 00165
Apr. 17, 2014 (FR) ..... 14 53499

(51) Int. Cl.
*A63C 9/085* (2012.01)
*A63C 9/08* (2012.01)
*A63C 9/086* (2012.01)

(52) U.S. Cl.
CPC ..... *A63C 9/08592* (2013.01); *A63C 9/086* (2013.01); *A63C 9/0807* (2013.01); *A63C 2201/06* (2013.01)

(58) Field of Classification Search
CPC ... A63C 9/08592; A63C 9/086; A63C 9/0807; A63C 2201/06
See application file for complete search history.

(56) References Cited

U.S. PATENT DOCUMENTS 2,172,669 A * 9/1939 Taft ..... A63C 9/02 280/614
3,825,273 A * 7/1974 Greene ..... A63C 9/084 280/618

(Continued)

FOREIGN PATENT DOCUMENTS

DE 19856143 A1 6/2000
EP 0199098 A2 10/1986
EP 1790396 A2 5/2007

OTHER PUBLICATIONS

Telemark, "Telemark Bindings Made in France", Telemark-Coeur, Apr. 19, 2014, retrieved from <www.telemarcoeur.com/blog/fixations-de-telemark-made-in-france.html>.

*Primary Examiner* — Jacob B Meyer
(74) *Attorney, Agent, or Firm* — Jordan IP Law, LLC; Todd A. Vaughn

(57) ABSTRACT

A binding for a touring ski, a Telemark ski or a cross-country ski having "step in" automatic locking. The binding includes a front retaining element to cooperate with the front sole of a boot, a rear retaining element to cooperate with the rear part of the front sole and/or the rear sole of the boot, a tensioning element to tension the boot on the binding and to enable the heel to be freely lifted, a tensioning link placed under and connected to a rear retaining stirrup, and a fixed or retraction stop to cooperate with the tensioning link so as to enable the rear retaining stirrup to move back, tensioning the tensioning element, when the heel of the boot exerts a downwardly directed pressure on the rear retaining boot situated in an idle position.

20 Claims, 15 Drawing Sheets

(56) References Cited

U.S. PATENT DOCUMENTS 3,865,388 A * 2/1975 Haldemann ..... A63C 9/081 123/505
3,944,237 A * 3/1976 Teague, Jr. ..... A63C 9/001 280/618
4,182,524 A * 1/1980 Beyl ..... A63C 9/0846 280/618
4,273,355 A * 6/1981 Storandt ..... A63C 9/086 280/614
4,659,103 A * 4/1987 Tessaro ..... A63C 9/20 280/615
4,836,572 A * 6/1989 Pozzobon ..... A43B 5/0413 280/613
5,040,819 A * 8/1991 Horn ..... A63C 9/005 280/618
5,085,456 A * 2/1992 Horn ..... A63C 9/005 280/618
5,108,125 A * 4/1992 Callegari ..... A63C 9/20 280/615
5,282,642 A * 2/1994 Provence ..... A63C 9/20 280/615
5,671,941 A * 9/1997 Girard ..... A63C 9/20 280/613
5,897,127 A * 4/1999 Hauglin ..... A43B 5/0492 280/613
5,944,337 A * 8/1999 Girard ..... A63C 9/20 280/613
6,209,903 B1 * 4/2001 Girard ..... A63C 9/20 280/613
6,454,291 B1 * 9/2002 Hillairet ..... A63C 9/0842 280/616
6,964,428 B2 * 11/2005 Quellais ..... A43B 5/0413 280/613
6,986,526 B2 * 1/2006 Haughlin ..... A63C 9/20 280/613
7,111,865 B2 * 9/2006 Girard ..... A43B 5/0413 280/613
7,246,812 B1 * 7/2007 Ayliffe ..... A63C 9/20 280/615
7,264,263 B2 * 9/2007 Riedel ..... A63C 9/20 280/614
7,735,851 B2 * 6/2010 Shute ..... A63C 7/1026 280/613
7,931,292 B2 * 4/2011 Miralles ..... A43B 13/141 280/611
8,328,225 B2 * 12/2012 Prigge ..... A63C 9/006 280/614
8,398,110 B2 * 3/2013 Morin ..... A63C 9/00 280/614
9,016,713 B2 * 4/2015 Wollo ..... A63C 9/02 280/614
2003/0047912 A1 * 3/2003 Hauglin ..... A63C 9/00 280/615
2003/0155742 A1 * 8/2003 Riedel ..... A63C 9/20 280/615
2006/0087088 A1 * 4/2006 Coles ..... A63C 9/02 280/11.31
2006/0087102 A1 * 4/2006 Coles ..... A63C 9/02 280/626
2008/0185820 A1 * 8/2008 Hauglin ..... A63C 9/0807 280/615

* cited by examiner

SELF-LOCKING BINDING FOR TELEMARK SKI, TOURING SKI OR CROSS-COUNTRY SKI

CROSS-REFERENCE TO RELATED APPLICATIONS

The present application is a National Stage Application of PCT International Application No. PCT/FR2015/050171 (filed on Jan. 26, 2015), under 35 U.S.C. § 371, which claims priority to French Patent Application Nos. 14/00165 (filed on Jan. 24, 2014) and 1453499 (filed on Apr. 17, 2014), which are each hereby incorporated by reference in their respective entireties.

TECHNICAL FIELD

The present invention relates to a binding for a touring ski, a Telemark ski or a cross-country ski with so-called "step in" automatic locking.

BACKGROUND

Traditionally, bindings for touring skis, Telemark skis or cross-country skis require release manipulation in order to open the binding or preparation manipulation to enable the boot to be fitted. Apart from the opening of the binding, it is practically always necessary to effect manual action directly by hand or by means of a ski pole for locking the boot on the ski.

In Telemark, the most usual equipment is bindings in accordance with the "75 mm standard", such as for example the bindings described in the U.S. Pat. No. 7,401,802 (Black Diamond Equipment). This type of binding is characterized by a fixed front clamp that holds the so-called "ducks beak" shape situated at the front of the boot and a cable tension system equipped with a spring locking on the heel of the boot. This boot standard makes it tricky to walk on rocks when climbing, does not allow the use of standard glacier crampons and limits the use of this type of boot solely to the Telemark ski. In addition, fitting the boots in the bindings is always very tricky. The skier is often obliged to place a knee on the ground in order to lock the ski and to be able to lock the tension system on the heel of the boot. These operations are made more difficult when snow is present, since the skis, being rarely equipped with a ski stop, easily slip, sometimes making the locking operation tedious. Finally, ejection of the ski in the event of a fall is practically impossible, and the use of these bindings therefore has a high risk of injury for skiers.

In the middle of the years 2000, a group of manufacturers defined a new standard, referred to as "New Telemark Norm" or NTN, which established a novel ski/boot interface standard. The novel boots defined by the standard can be used with a Telemark or alpine ski, and can receive normal glacier crampons. The sole of the boot is divided into two parts: the front sole, specific to the NTN standard, and the heel, which is conventional and separate from the front sole. The specificity of the front sole stems from the projection that is situated at the arch at the middle of the boot, at the rear end of the front sole. Thus the boot can be secured to the ski while being held between the front part of the front sole and the projection. This standard made it possible to create bindings that combine the freedom of movement of the heel particular to the Telemark and include a safety device releasing the ski in the event of the skier falling. Responding to several problems with the 75 mm standard, these bindings can also include ski stops and afford additional safety for skiers.

The Telemark bindings as described in the document EP 1 790 396 (Rottefella) are binding models complying with the NTN standard. These bindings do however require manual release, tricky fitting of the boot and action for locking the latter by hand, with the free hand or using a ski pole. These bindings are also characterized by a weight greater than the average of the bindings available on the market.

In parallel to the development of these bindings, boot manufacturers have included, in certain models in their range, front and rear interfaces particular to bindings of the Dynafit® type. These interfaces of the Dynafit® type are characterized by the presence of two hollow conical inserts situated on the front tip of the sole and an insert plate on the heel. NTN Telemark boots equipped with these interfaces enable the skier to use them either on skies equipped with an NTN Telemark binding or on skis equipped with tourist bindings to the Dynafit® standard. Users greatly appreciate the versatility of this type of new generation of boot. The invention described in the present patent application uses this model of boot.

Starting on the basis of this concept of boot to the NTN standard and equipped with a Dynafit® interface, a binding model has appeared, associating the front part of the Dynafit® binding and the locking tension system on the heel of the boot particular to Telemark fixings to the "75 mm standard". This system ensures the holding of the front of the boot by means of the clamps (forks) of the Dynafit® binding, while the tensioning of the boot is provided by the conventional heel block system held by the cable/spring assembly of the Telemark bindings to the "75 mm standard". This system makes it possible to obtain a functional and effective assembly in Telemark mode, with a reasonable weight and effective in tourist skiing, but does however require manual locking of the boot and limits the safety of the skier because of difficulty in ejecting the skis.

Finally, through U.S. Patent Publication No. 2003/0047912, a ski binding is known, the "step in" function of which is provided by two levers, one of which is articulated on the base of the binding and the other one of which can slide, by means of its free end, in a slot in this base. The boot locking zone is moreover secured to the sliding lever with respect to translation. When the user presses downwards on the locking zone, the latter drives the lever sliding forwards, so that this locking zone tends to advance with respect to the boot, which performs the fixing operation proper.

The problem addressed by the present invention is to allow both automatic locking of the boot in the binding, the use of the binding in tourist mode without detachment of the skis, easy ski detachment actuated by the skier and automatic ski detachment in the case of a fall, while using a binding with a total weight that is as low as possible.

SUMMARY

According to the invention, the problem is solved by a ski binding, in particular a binding for a touring, Telemark and/or cross-country ski, for fixing a ski boot comprising a front sole and a heel, said ski binding comprising:

a front retaining element, able to cooperate with the front sole of the boot, a rear retaining element able to cooperate with a projection on the rear part of the front sole and/or with the rear sole of the boot, said rear retaining element being able to pivot, while raising or lowering its rear part, in the vertical plane about a horizontal axis (which may be a physical or virtual axis) orthogonal to the direction of the ski between a so-called upper position (or "idle position") and a so-called lower position (or "engaged position"), a tensioning element that acts between the rear retaining element and the ski and/or the front retaining element, able to tension the boot on the binding and to enable the heel to be freely lifted, said binding being characterized in that it also comprises:

a tensioning link placed under the rear retaining stirrup and connected to the latter, so as to enable said rear retaining stirrup to pivot in the vertical plane about a horizontal axis orthogonal to the direction of the ski, a fixed stop (also referred to as the "retraction stop") placed on the ski or the front retaining element, able to cooperate with the tensioning link, so as to enable the rear retaining stirrup to move back, tensioning said tensioning element, when the heel of the boot exerts a downwardly directed pressure on the rear retaining boot situated in the idle position.

The front retaining element is advantageously a binding system of the Dynafit® type, with a double locking lug on the boot. The front retaining element comprises a control element, such as a latch, that can be actuated by the user, which transmits this movement to the clamps by means of a front link.

The retraction stop cooperates with the tensioning link and, when the boot is engaged in the rear retaining element, converts the vertical force exerted by the heel of the boot on the rear retaining element into a horizontal movement in the rear direction of said rear retaining element, which allows the engagement of said rear retaining element (preferably by means of a rear attachment clamp) either on the rear projection of the front sole or on the heel.

According to one embodiment of this binding, the rear part of said rear retaining stirrup or of said tensioning element is connected to the rear part of said tensioning link. The tensioning link enables the retaining stirrup to pivot between a high position and a low position.

The rear retaining stirrup may be connected to the front retaining element by a flexible connecting element. The latter may, in its rear part, have a guide that slides in the slide of the rear retaining element.

According to another embodiment, which may be combined with the previous one, said tensioning link, when the rear retaining element is engaged, abuts with its front end against said fixed stop.

According to another embodiment, which may be combined with one or more of the previous ones, when the rear retaining stirrup is released from the retraction tension and when the projection of the rear part of the front sole or the heel of the boot is inserted in the rear retaining stirrup, the projection of the rear part of the front sole or the heel of the boot bears on a tongue of the link, and locks said link in the retracted position.

According to yet another embodiment, which may be combined with one or more of the previous ones, the rear retaining element is designed so that, when the boot is fitted in the rear retaining element, after locking of the front retaining element on the front part of the front sole, when the user lowers the heel, the rear sole bears on the rear retaining stirrup or an element associated with the rear retaining stirrup, and imposes a retraction of the rear retaining stirrup under the effect of the link, itself in abutment on the fixed retraction stop, so that this retraction of the rear retaining stirrup enables the projection or heel of the boot to be inserted in the rear retaining stirrup.

According to yet another embodiment, which may be combined with one or more of the previous ones, the rear retaining element also comprises a retraction protrusion placed behind the fixed stop or integrated in the tensioning link, able to release the tensioning link from its abutment on the fixed stop when the projection or the heel of the boot is inserted in the rear retaining stirrup.

According to yet another embodiment, which may be combined with one or more of the previous ones, said tensioning element comprises two elastic return members (typically springs) disposed on either side of the rear retaining element, and preferably inside the rear retaining stirrup, and at least one knurled ring for adjusting the preloading of the tensioning element, and said tensioning element preferably comprising in addition a set of rods and cables that cooperate with said springs for tensioning the retaining stirrup. Said rods may be disposed inside said springs, typically parallel to the direction of the binding (i.e. parallel to the ski). The cables may be replaced by an arch.

According to yet another embodiment, which may be combined with one or more of the previous ones, the binding comprises a control element (typically a latch) that can be actuated by the user, said control element (latch) making it possible to keep the rear retaining stirrup sufficiently retracted to prevent the projection or heel from being hooked by the rear retaining stirrup, either by acting directly on the rear retaining stirrup or by acting directly on the tensioning link. This is suitable for practicing cross-country skiing or tourist skiing.

According to yet another embodiment, which may be combined with one or more of the previous ones, said rear retaining stirrup comprises two lateral stops, disposed on either side of its rear part, so as to center the rear projection of the front sole of the boot on said rear retaining stirrup, said lateral stops preferably being disposed so as to be able each to pivot about a vertical axis under the effect of a torque generated by a lateral movement of the boot when the ski is removed.

According to yet another embodiment, which may be combined with one or more of the previous ones, the tensioning link is connected to the tensioning element or to the rear retaining stirrup by means of a spindle that is situated in the plane of said tensioning element, enabling the rear retaining stirrup to slide parallel to the plane of said tensioning element.

According to yet another embodiment, which may be combined with one or more of the previous ones, the front retaining element comprises three components, namely a specific element (latch), a slide and a pivoting element; the slide can move in the front-to-rear direction in order to release or lock said pivoting element. When the binding is in Telemark mode, the user can pivot the element forwards, and a protuberance on said element bears on said slide and slides it towards the rear, releasing said pivoting element to enable the skier to easily lift the boot in order to practice tourist skiing. The user can thus switch into "tourist skiing" mode without removing the skis.

According to yet another embodiment, which may be combined with one or more of the previous ones, the tensioning link bears in service on the retraction stop at a bearing point that is situated in front of the connection point between this link and the retaining stirrup, in side view and with reference to the direction of movement of the ski.

According to yet another embodiment, which may be combined with one or more of the previous ones, the tensioning link is mounted so as to be able to pivot on the rear retaining stirrup about an axis orthogonal to the direction of the ski. The tensioning link can in particular bear in service on the retraction stop at a point that is situated in front of said pivot axis of this link, in side view and with reference to the direction of movement of the ski.

According to yet another embodiment, which may be combined with one or more of the previous ones, the rear retaining element comprises a front part that is free to pivot with respect to the front retaining element, about a transverse axis, while being translationally connected with respect to this retaining element, the rear retaining stirrup having a degree of freedom in translation with respect to the front part, along the longitudinal axis of the ski.

According to yet another embodiment, which may be combined with one or more of the previous ones, the rear retaining element is provided with removable fixing means, for the removable fixing of blades, said blades being able to pivot with respect to the rear retaining element about a transverse axis. In particular, the removable fixing means may comprise a fixing member delimiting a housing, suitable for receiving by sliding a pivoting rod, secured to said blades.

According to yet another embodiment, which may be combined with one or more of the previous ones, the binding comprises a heel block and a heel block support, this heel block being mounted so as to be able to move with respect to the support between an access position in which it allows access to a housing of the support, this housing being able to receive a sensor, and a covering position in which it prevents access to this housing while protecting this sensor.

According to yet another embodiment, which may be combined with one or more of the previous ones, the binding comprises a control element allowing control of the front retaining element as well as a member for locking this control element, this locking member being able to move between a neutral position in which it does not interfere with the movement of the control element and a locking position in which it prevents the movement of the control element in order to prevent any unwanted disengagement of the boot with respect to the front retaining element. The locking member may in particular extend through a recess in the control element and this locking member then has a locking zone able to come into abutment against the walls of this recess, in said locking position.

DRAWINGS

FIGS. 1 to 22 illustrate embodiments of the invention.

FIGS. 1, 2, 4, and 5 show the binding in the idle position (ready to be occupied by the boot): FIG. 1 shows a perspective view, FIG. 2 a plan view, FIG. 4 a side view, FIG. 5 a lateral view in cross section.

In FIG. 7 the boot is beginning to be inserted in the rear retaining element, in FIG. 8 the boot is inserted in the rear retaining element.

DESCRIPTION

In this description the expressions "front", "rear", "in front of", "behind", "advances" and "retracts" refers to the direction of the ski in the normal situation of use.

Figure 1:
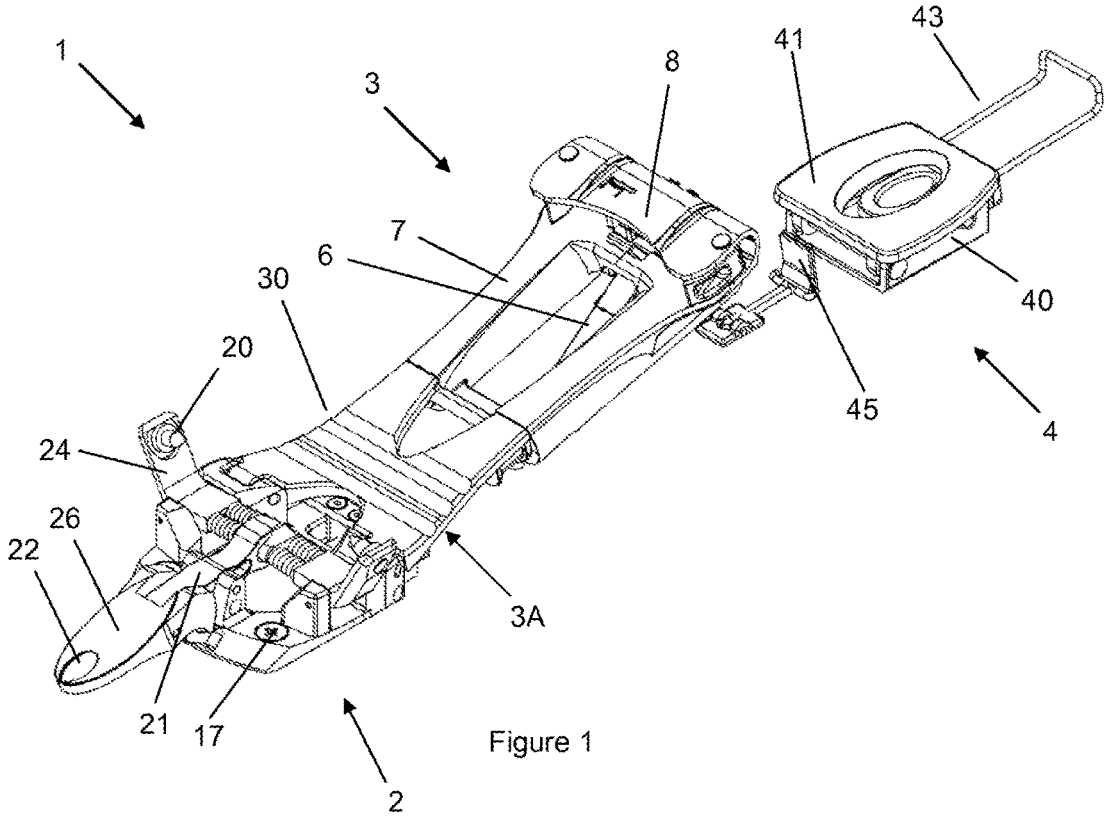
Figure 2:
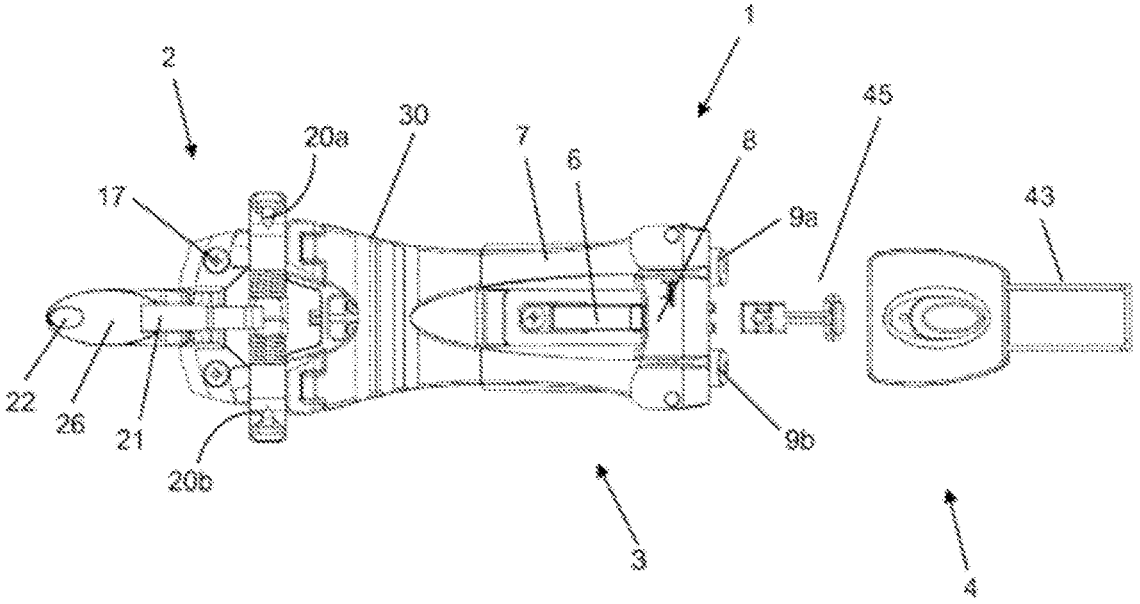

As illustrated in FIGS. 1 and 2, the binding 1 according to the invention comprises a front retaining element 2, a rear retaining element 3 and a heel block 4. These three elements are fixed to the ski, typically by fixing screws 17, directly or by means of a fixing plate.

The main function of the heel block 4 (visible in particular in FIG. 9) is to allow the positioning of the heel of the boot on a support surface 41 at a given height; the heel block is fixed to the ski by means of a support 40; it may comprise in a known manner a chock 43 (referred to as the "top chock").

The front retaining element 2 is known as such; it may advantageously be a known front retaining element of the so-called "Dynafit®" binding comprising two conical lugs 20*a*, 20*b* that each cooperate with a hollow conical insert 23 situated on the right and left side of the front part of the front sole 11 of the boot 5. The front retaining element 2 in the "open" (disengaged) position is actuated by the forward movement of the tip of the front sole of the boot 5, by means of the front link 21, as will be described below. The lugs 20*a*, 20*b* are each mounted on a clamp 24, which is actuated by the front link 21; in the engagement position of the front retaining element 2, these clamps 24 move the lugs 20*a*, 20*b* laterally closer to the front part 14 of the front sole 11, so as to enable the lugs 20*a*, 20*b* to be inserted in said hollow inserts 23. Thus the front retaining element 2 makes it possible to hold the boot 5 in a position which, when the rear sole 13 of the boot 5 is not retained in a low position and can be raised, allows easy tilting of the front part 14 of the front sole 11 about a horizontal axis, orthogonal to the long direction of the ski; this axis passes through the lugs 9*a*, 9*b*.

Any other type of front retaining element 2 that allows easy tilting of the front part 14 of the front sole 11 about the horizontal axis, orthogonal to the long direction of the ski, can be used in the context of the present invention. Preferably, this front retaining element 2 is designed so as to allow disengagement of the front part 14 of the front sole 11 of the boot 5, by a control element (typically a latch) 26 actuated by the skier by hand or with pressure from the tip of the pole. In the example of the front retaining element of the Dynafit® type, in order to disengage the boot from the front retaining element 2, the front retaining element 2 can be actuated by a control element (here a latch) 26 that actuates a front link 21; said control element (latch) 26 can be actuated by the skier by hand or by exerting a substantially vertical pressure with the tip of his pole; in order to easily accept this tip of the pole, the latch 26 may have a hollow zone 22. This actuation, manual or with the pole, causes the opening of the front retaining element 2, which releases the front sole 11 of the boot 5.

It is on the retaining element 3 that the present invention is based. It first of all comprises a front part 3A, which is free to pivot with respect to the front retaining element 2, about a transverse axis, while being translationally connected with respect to it. The rear retaining element 3 moreover comprises a rear retaining stirrup 7, having a degree of the freedom in translation with respect to the front part 3A, along the longitudinal axis of the ski. This translation movement, from rear to front, takes place counter to a tensioning element described below. This rear retaining stirrup 7 is connected to a link 6 referred to as the tensioning link, namely this link can pivot with respect to this stirrup about a transverse axis A6. In addition, said rear retaining stirrup 7 is, in its rear part, secured to the rear attachment clamp 8 able to attach to the rear projection 46 of the front sole 11. The rear retaining element 3 moreover comprises a tensioning element 35 mentioned above, which typically comprises at least one spring 31 (or other elastic return member) and one or more transmission elements, for example a system comprises rods 32 and at least one cable 33 (visible in FIG. 3).

Figure 4:
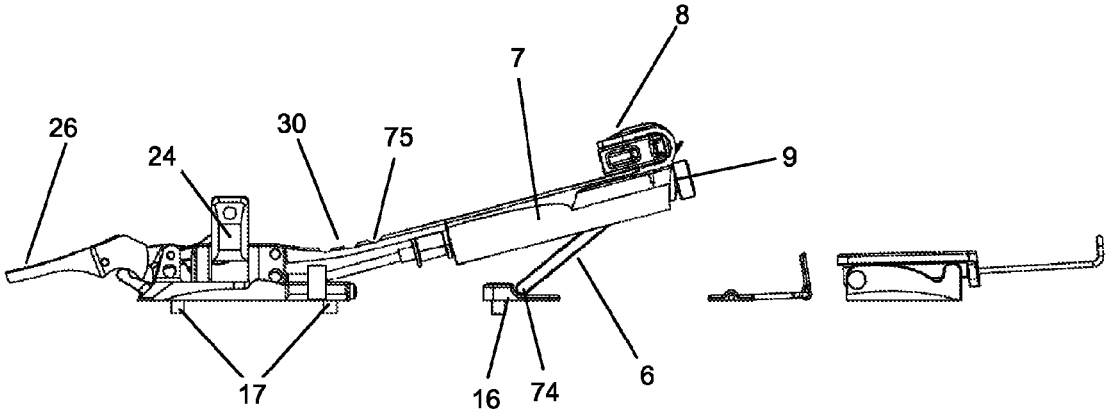
Figure 5:
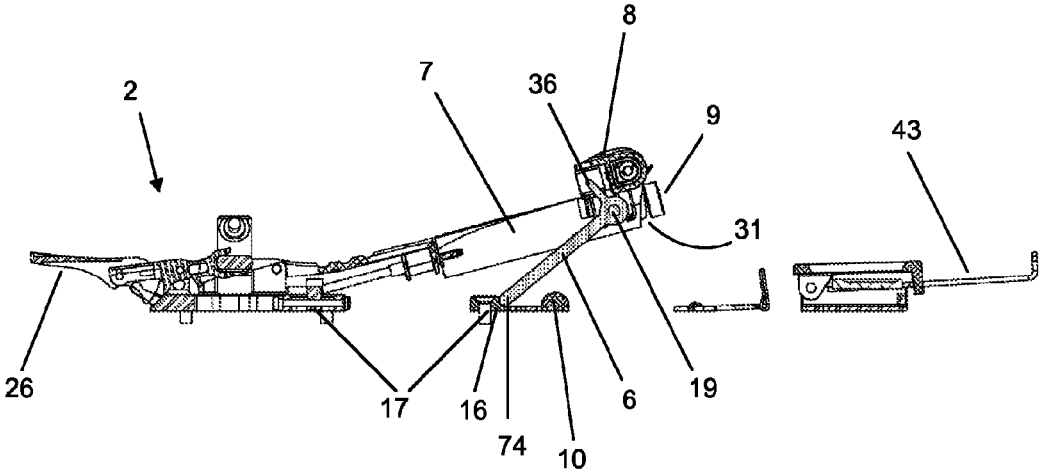
Figure 9:
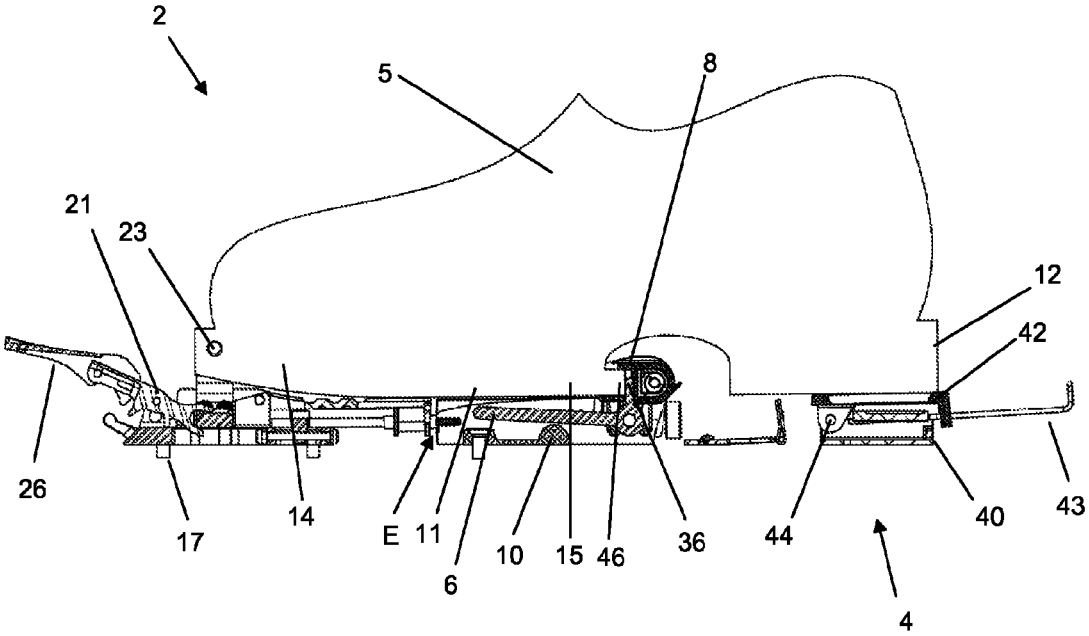
FIG. 9 shows the same cross section as FIGS. 7 and 8, with the boot engaged in the locked position.

The rear retaining stirrup 7 can tilt between a high position referred to as the "idle position", illustrated in FIGS. 4 and 5, and a low position referred to as the "locked position" illustrated in FIG. 9. This tilting is guided by a link 6 referred to as the "tensioning link" positioned on the rear retaining stirrup 7. The rear part of the rear retaining stirrup 7 is movably connected to the rear end of the tensioning link 6. The front end 74 of the tensioning link 6 can be engaged in a fixed stop 16, fixed to the ski. When the skier lowers the heel 12 of his boot 5, this downward vertical movement engages the front end 74 of the tensioning link 6 in the stop 16 and causes the retraction of the rear retaining stirrup 7. This retraction movement tensions the tensioning element 35; it allows the engagement of the rear projection 46 of the front sole 11 by the rear attachment clamp 8 of the rear retaining stirrup 7.

Figure 3:
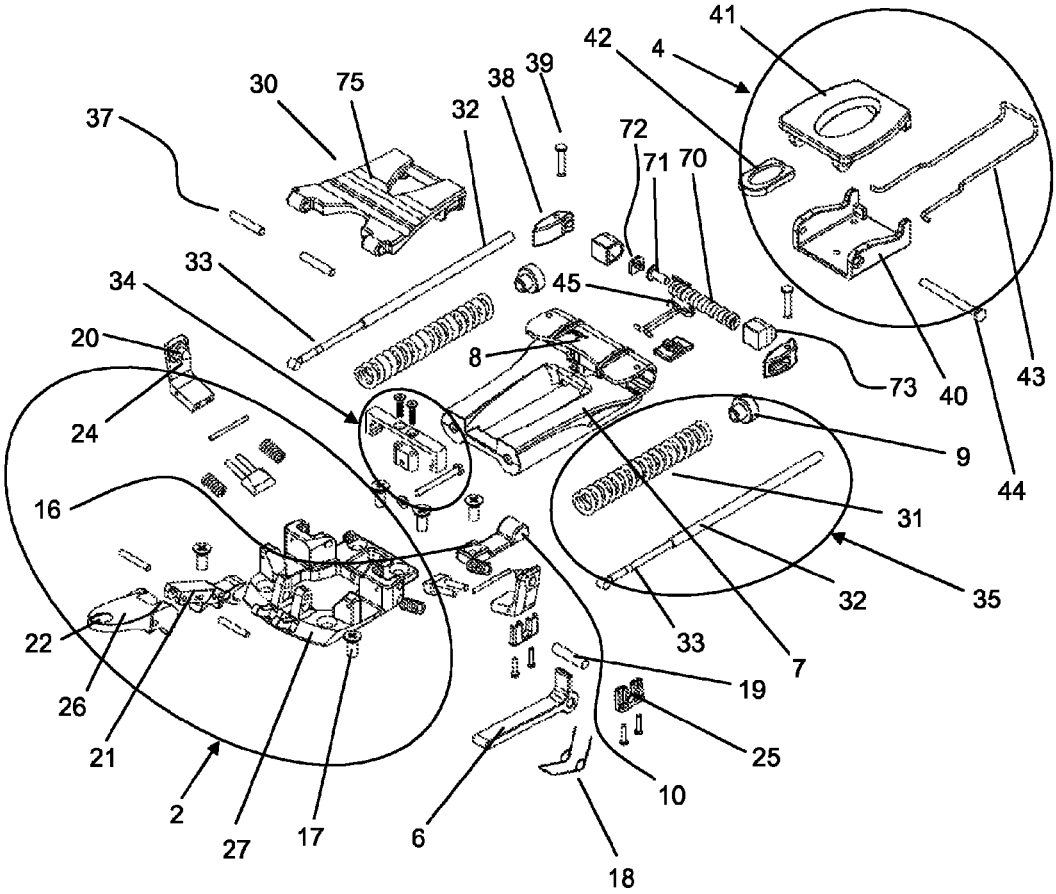
FIG. 3 shows an exploded view in perspective of the binding that makes it possible to view all the parts that make up the equipment.

In addition to the front retaining element 2 and the rear retaining element 3, FIG. 3 shows the various components that form the tensioning element 35: the rods 35 and the cable 33, as will be explained below.

The tensioning link 6 can be equipped with an elastic return member (typically a spring) 18 that presses it downwards.

We now give a precise description of the functioning of the binding 1 according to the invention, and in particular its rear retaining element 3, referring in particular to FIGS. 6 to 9.

Figure 6:
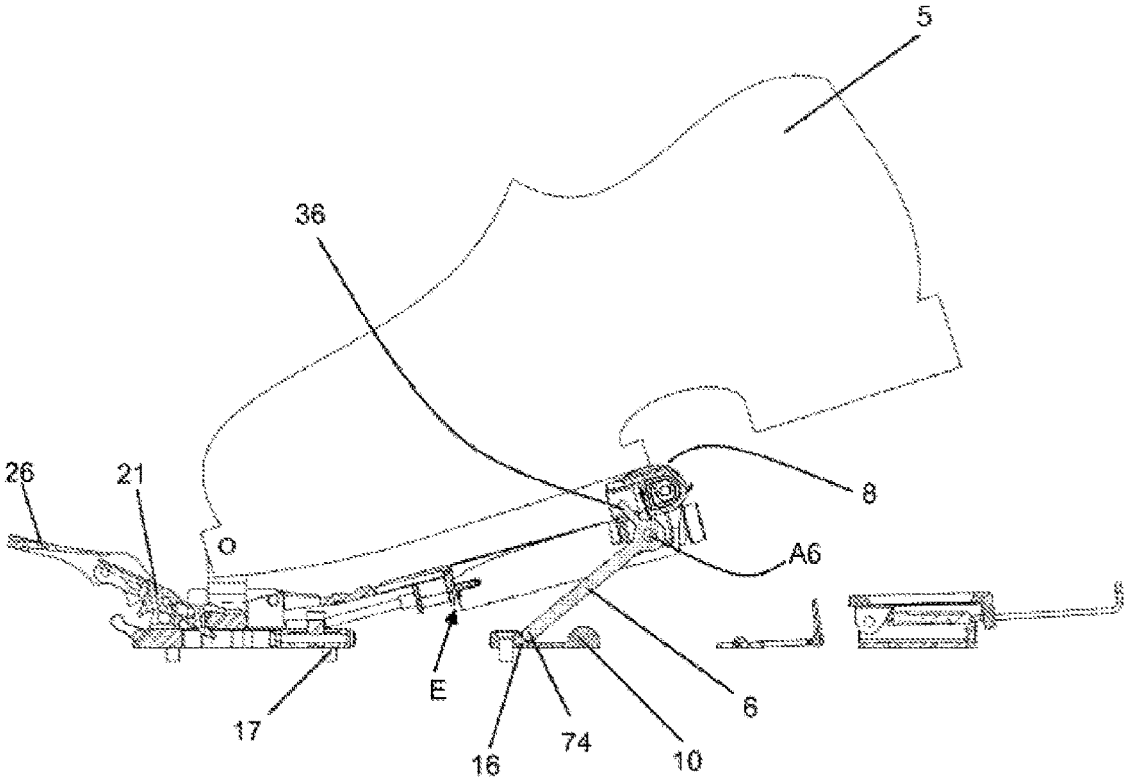
FIG. 6 shows a lateral view in cross section of the binding in the idle position with the boot already held by the front retaining stirrup.
Figure 7:
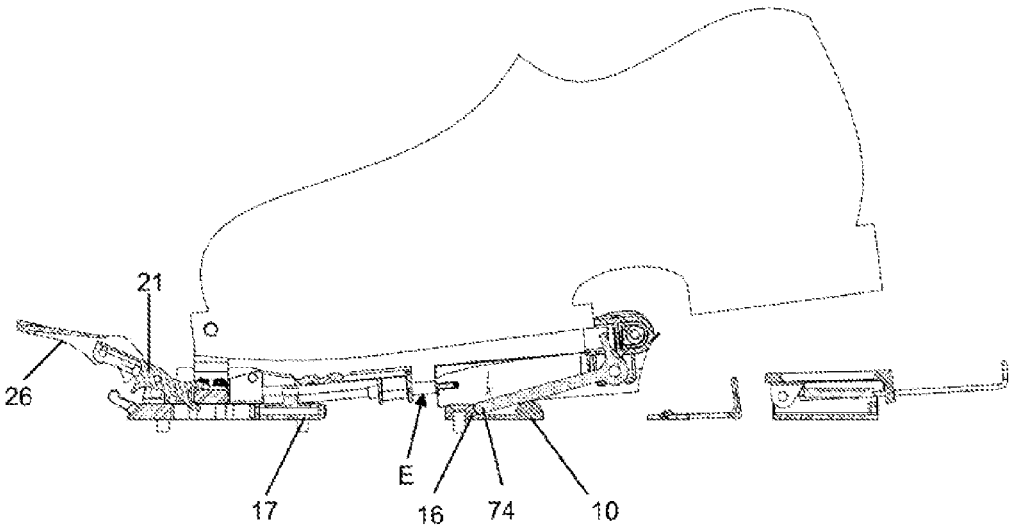
FIGS. 7 and 8 depict a lateral view in cross section of the binding that shows the boot being gradually inserted in the rear retaining element, before the tensioning ring is retracted.

In the idle position of the binding 1, the front retaining element 1 is in the open position (for example, in a front retaining element 1 of the Dynafit® type, the flanges 24 are open), and the tensioning link 6 and the rear retaining stirrup 7 are in the high position (raised position): the idle position is the position in which the binding 1 is ready to have the boot inserted. FIG. 6 shows more particularly the idle position for the rear retaining element 3 according to the invention.

When the user has engaged the front retaining element 2 (that is to say, in the example of the Dynafit® retaining element described above: locks the front clamps 24 by means of the lugs 20*a*, 20*b*, which cooperate with the hollow inserts 23 of the boot 5), he merely needs to lower his heel 12 in order to lock the boot 5 in the rear retaining element 3 according to the invention. When the skier lowers the heel 12 of his boot 5, the rear sole 13 of the boot 5 bears on an interface piece (not shown in the Figures) or directly on the rear retaining stirrup 7 and in fact forces the tensioning link 6 to bear on the fixed stop (also referred to as the retraction stop) 16 (see FIG. 7). The link bears on this fixed stop, at a point that is situated in front of the pivot axis A6 of this link 6, in side view and with reference to the direction of movement of the ski.

Figure 8:
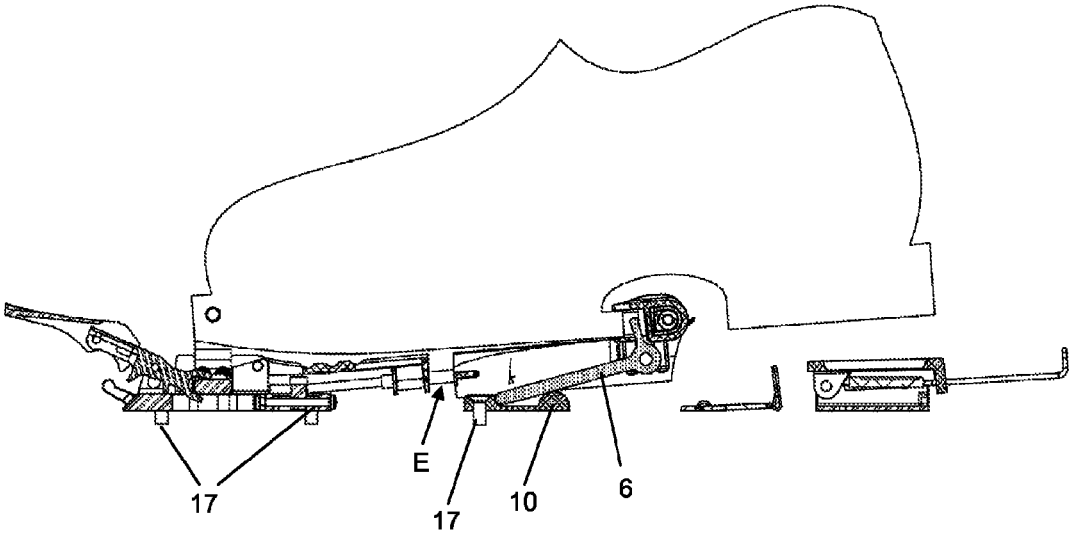

Under the vertical force imposed by the boot, the link 6, in abutment on the retraction stop 16, exerts a horizontal force on the rear retaining stirrup 7 directed towards the rear. This imposes a retraction movement on this stirrup with respect to the front part 3*a* of the rear retaining element 3. This retraction movement of the rear retaining stirrup 7 takes place counter to the tensioning element 35 of the rear retaining element 3, namely this tensioning element is actuated. (This advance and retraction movement of the rear retaining stirrup 7 can be noted in FIGS. 6 to 10 by the extent of the space represented by the arrow E). More precisely, this retraction movement tensions the internal springs 31 of the binding. The retraction movement of the rear retaining stirrup 7 continues until the projection 46 of the rear part of the front sole is inserted in the rear attachment clamp 8 (FIG. 8).

When the rear retaining stirrup 7 arrives in the retracted position, enabling the boot 5 to be inserted (in an advantageous embodiment of the rear retaining element 3 this will enable the projection 46 to be engaged by the rear attachment clamp 8), a suitable protuberance of the protrusion 10 type situated on the ski or an element 76 of the binding, such as for example on the retraction stop 16, retracts the tensioning link 6 by exerting an upwardly directed force on the front part of the tensioning link 6. This retraction of the link 6, which typically takes place about a horizontal axis 19, releases the retaining stirrup 7 from the retraction tension. The retaining stirrup 7, under the effect of the tension of the tensioning element 35, returns to the idle position and tensions the boot 5. In this situation the boot 5 is locked on the ski binding 1, and the skier can devote himself to Telemark skiing, knowing that the rear sole 13 of the boot 5 remains fixed in the rear retaining stirrup 7 and can be lifted by tilting it upwards; this movement will be more effective with a Telemark ski boot, the shell of which, in particular on the front part, is sufficient flexible.

In one embodiment, the fixed stop 16 is fixed to the ski. In another embodiment it is secured to the front retaining element 2.

In order to release the skis, the skier will simply have to release the part of the front sole 11 of the boot 5 held by the front retaining element 2, typically by exerting a vertical pressure with his pole on the latch 26. In the case of the front retaining element 2 of the Dynafit® type described above, when the skier actuates the control element 26 (in the example, when the skier presses on the latch 26), the clamps 24 separate on either side of the front sole 11, thus releasing the front part 14 of the front sole 11 by disengaging the lugs 20*a*, 20*b*, releasing the front tip of the boot. Since the boot 5 is no longer held, the skier merely needs to move his boot forward slightly in order to disengage the heel or the projection 46 and to remove his boot 5 from the binding 1.

When the projection 46 of the front part 15 of the front sole 11 is inserted in the rear clamp, it bears on the tongue 36 of the link 6 and locks it in the retracted position.

In an embodiment illustrated in FIGS. 5 to 9, a retraction protrusion 10 is provided on the tensioning link 6, which reinforces the tension of the tensioning element 35 of the rear retaining element 3.

According to a particular embodiment, the tension springs 31 of the tensioning element 35 are integrated in the rear retaining stirrup 7.

In one embodiment, the rear retaining element 3 is able to pivot, by raising or lowering its rear part, in the vertical plane about a horizontal axis orthogonal to the direction of the ski between a top position and a bottom position. This axis may be a physical axis and/or a virtual axis. A virtual axis may be represented by a flexible material, in this case a flexible connection element 30 formed on its front part 3A. A flexible connection element may have, during functioning thereof, a generalized and/or localized deformation, for example by means of one or more grooves 75 (see FIGS. 3 and 4), and/or may be fixed at its front end by a spindle 37.

In an embodiment illustrated in FIGS. 3 and 4, the dimensions of the flexible connection element 30 are chosen so as to guarantee that the rear retaining stirrup 7 is in a position such that the tensioning link 6 is placed downstream of the fixed stop 16.

Figure 10:
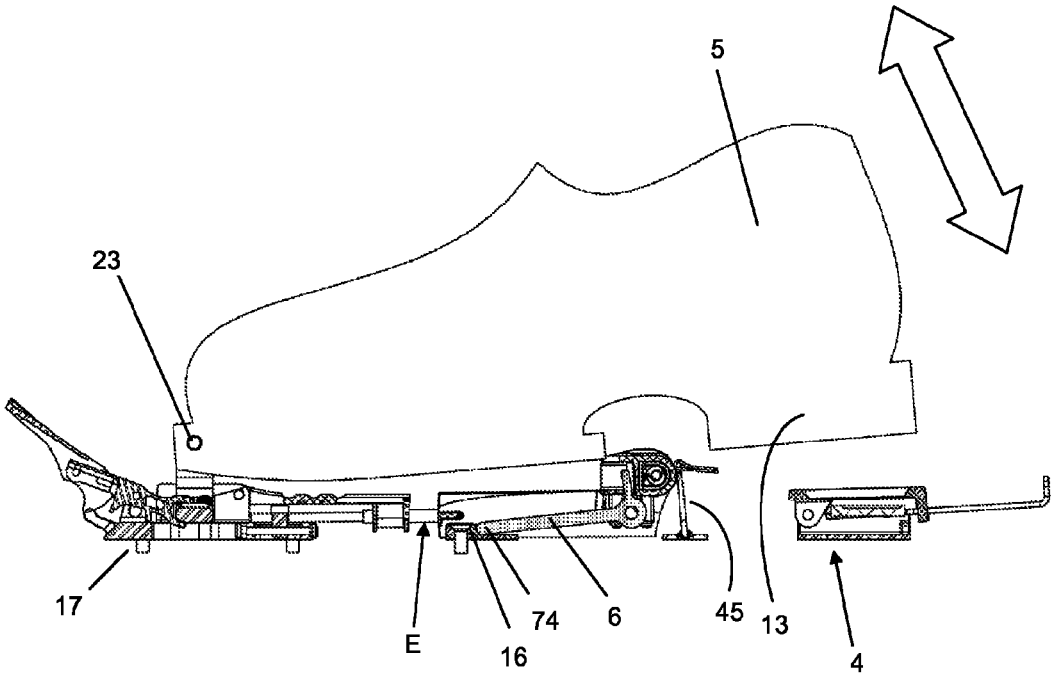
FIG. 10 shows a lateral view in cross section of the binding with the boot in the "tourist ski" or "cross-country ski" position.

In an embodiment illustrated in FIG. 10, the ski binding 1 according to the invention comprises a control element 45 able to be actuated by the user, said control element 45 making it possible to impose on the rear retaining stirrup 3 a position that is sufficiently retracted to prevent the projection 46 or the heel 12 from being hooked by the rear retaining stirrup 7, either by acting directly on the rear retaining stirrup 7 or by acting directly on the tensioning link 6. Said control element 45 may be a latch.

This makes it possible to pivot the rear sole 13 of the boot 5 freely upwards; the boot 5 being held solely by the front retaining element 2. This pivoting movement is represented by the double arrow in FIG. 10. This position is suitable for practicing cross-country skiing or touring skiing.

The control element or latch 45 may advantageously be disposed between the rear retaining element 5 and the heel block 4.

Figure 11A:
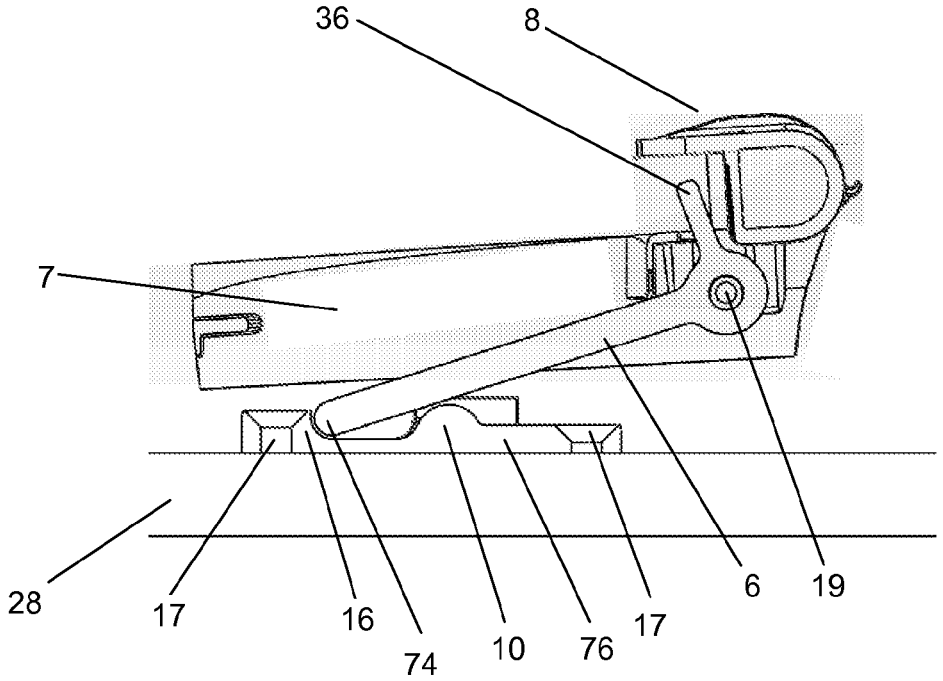
FIG. 11 illustrates two embodiments of the retraction protrusion, which is an optional element of the invention.
Figure 11B:
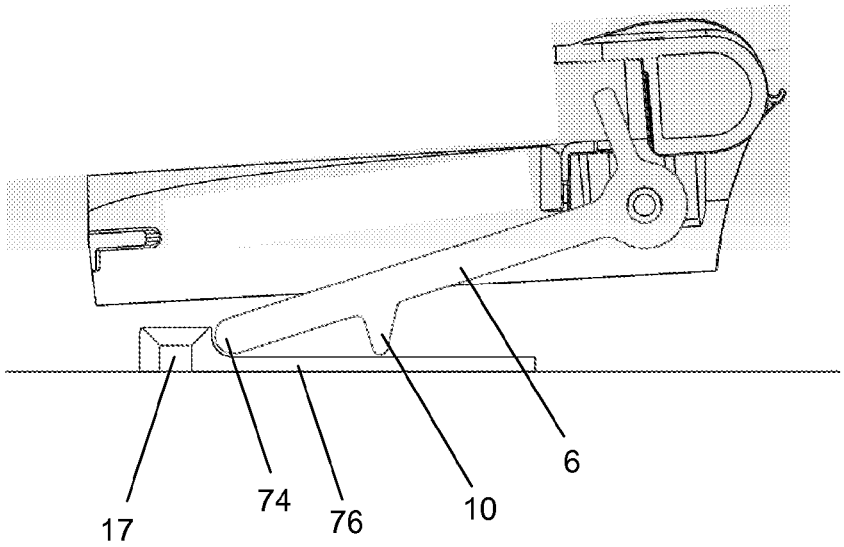

As mentioned above and illustrated in FIG. 11, the retraction protrusion 10, which is optional, may be situated either on the ski or on the base 76 that comprises the retraction stop 16, as shown in FIG. 11*a* (as well as in FIGS. 5, 6, 7, 8 and 9), or it may be integrated in the tensioning link 6, as illustrated in FIG. 11*b*. In the latter case it may be a protuberance directed downwards that cooperates with the surface of the base 76, or any other equivalent system.

Figure 12:
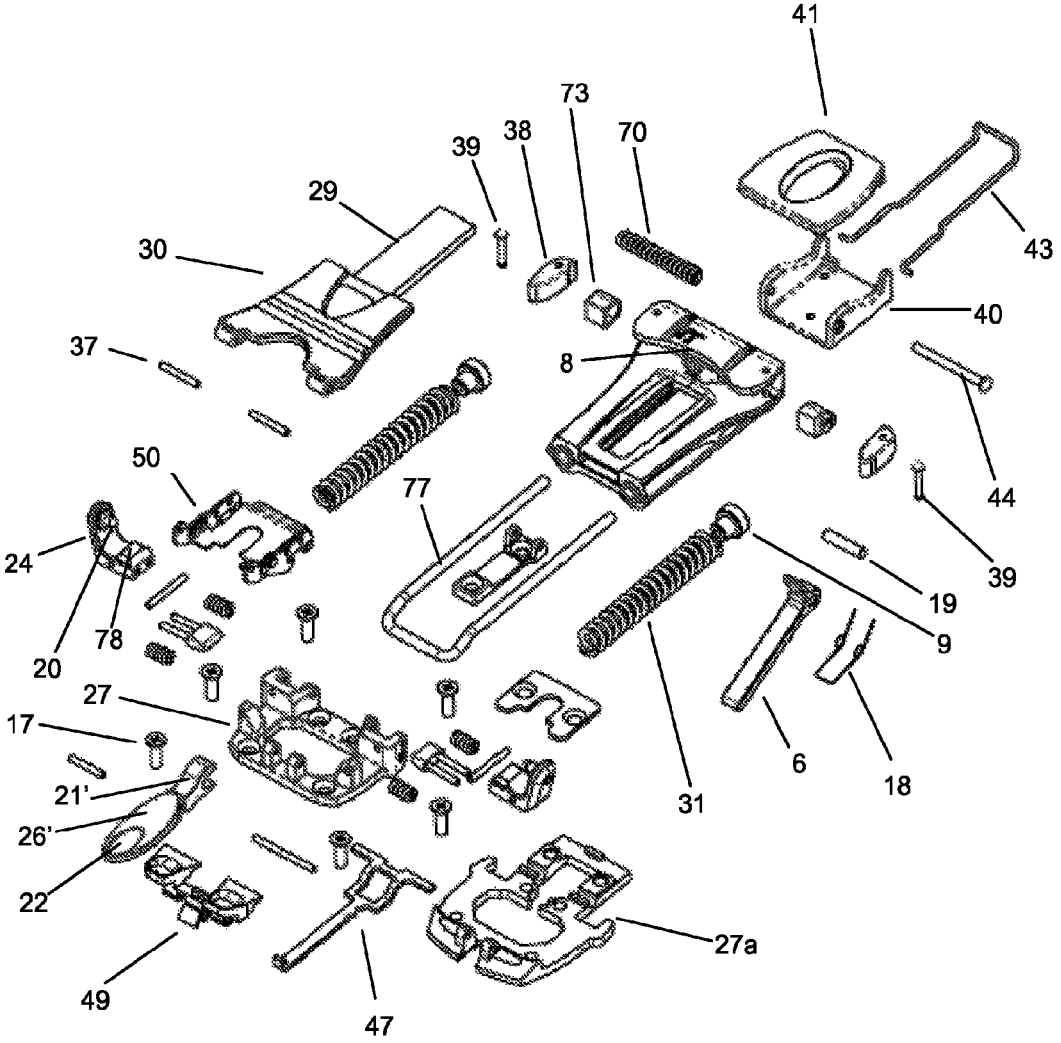
FIG. 12 shows an exploded view in perspective of another embodiment of the binding that makes it possible to view all the parts that make up the equipment.

FIGS. 12 to 14 and 16 illustrate five variants of the invention that can be implemented separately or, as in the embodiment shown in FIG. 12, together:

In a first variant, the flexible connecting element 30 includes a guide 29 that slides in the slide of the rear retaining stirrup 7. The guide 29 stiffens the lateral holding: it can be produced from plastics material. In particular, this variant has the advantage of providing better lateral stability of the boot 5 when the ski is removed, when the front part of the boot is no longer held by the front retaining element 2.

Figure 14:
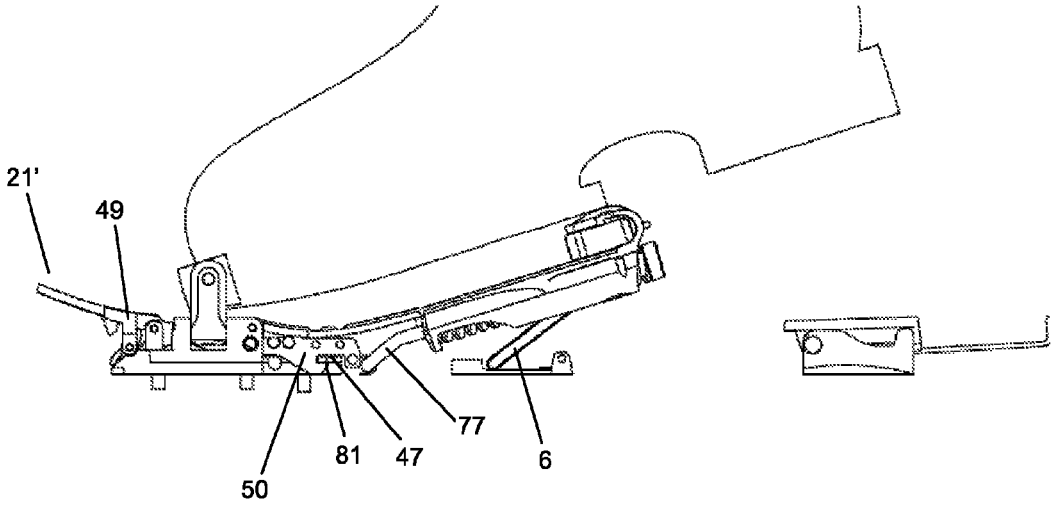
FIG. 14 shows a lateral view of the binding according to the same variant as that of FIG. 13, with the boot in the "Telemark" position.

In a second variant, the functioning of which is illustrated in FIG. 14, in the tensioning element 35 the cables are replaced by an arch 77; this makes it possible to control the point of inflection of the boot.

In a third variant illustrated in FIG. 16, in the front retaining element 2, the clamps 24*a*, 24*b* have a support surface 78*a*, 78*b* for the front part 15 of the front sole 11.

Figure 13:
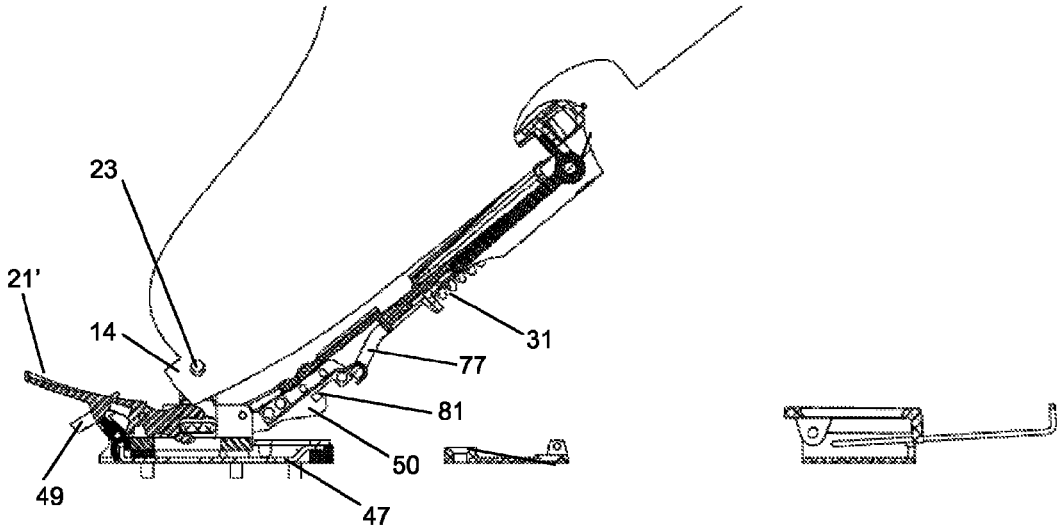
FIG. 13 shows a lateral view in cross section of the binding according to a variant of the invention, with the boot in the "touring ski" position.

In a fourth variant, the function of which is illustrated in FIGS. 13 and 14, the cooperation between three components of the front retaining element 2, namely the "touring mode" control latch 49, the slide 47 and the touring pivot assembly 50 enables the user to switch from "touring skiing" mode (FIG. 13) to the "Telemark" mode (FIG. 14) and vice versa without removing the skis. This fourth variant represents an innovative modification of the front retaining element 2; it offers a novel functionality that will be explained below in relation to FIG. 16.

The touring-mode control latch 49 is dissociated from the front link 21' but still provides the function of locking the front link 21' for touring mode but now it makes it possible to slide the slide 47 from front to rear in order to release or lock the touring pivot assembly 50.

Figure 16A:
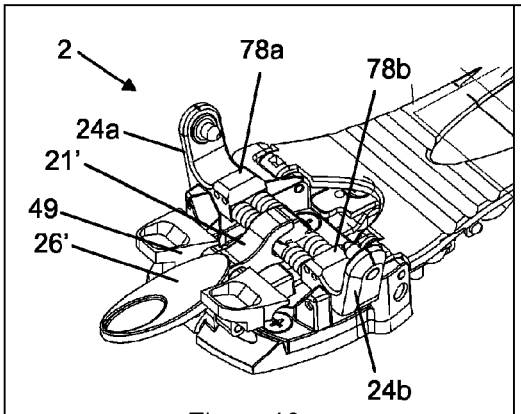
FIG. 16 shows a detail of the device shown in FIGS. 12, 13 and 14, the function of which it illustrates.
Figure 16B:
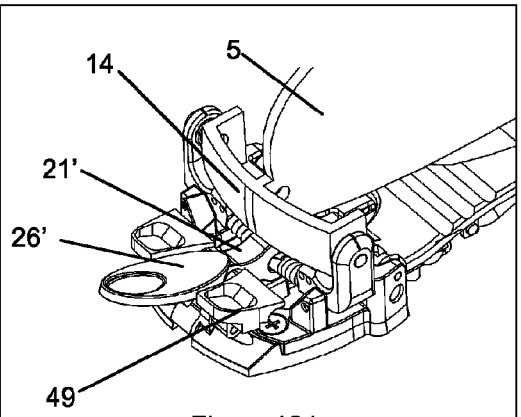
Figure 16C:
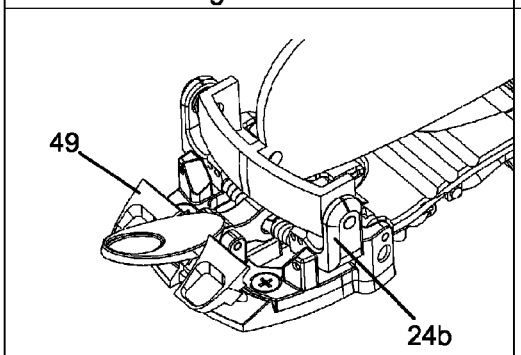
Figure 16D:
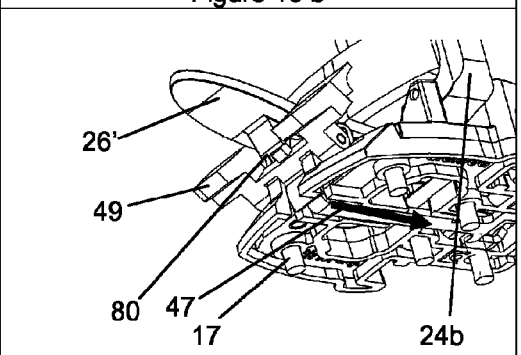
Figure 16E:
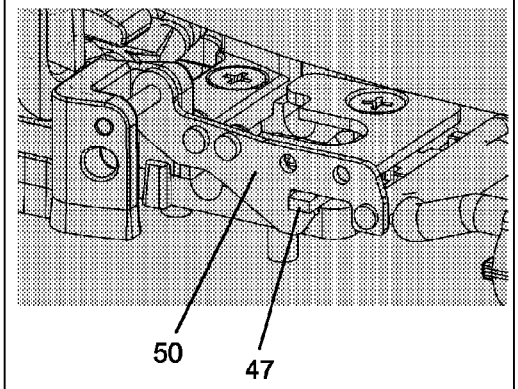
Figure 16F:
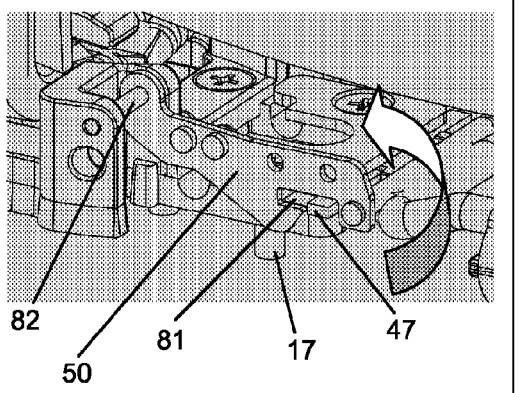

The touring pivot assembly 50 that was locked by the touring slide 47 can now pivot about two axes (82), see FIG. 16*f*. When the binding is in Telemark mode, the user can pivot the element 49 forwards, a protuberance on the part bears on the slide 47 and slides it towards the rear, actually releasing the touring pivot assembly 50. This released assembly enables the skier to easily lift the boot in order to practice touring skiing as described in FIG. 13. The user (the skier) can thus switch into "touring skiing" mode without removing the skis.

Moreover, it is noted that, in FIG. 12, the plate 27 was produced in two pieces 27, 27*a*. In this sub-variant, the main body 27 is placed on a chock (for example made from plastics material) 27*a* that integrates guides in the middle part in order to hold the slide 47 during sliding. This sub-variant limits the machining cost.

It should be noted that the embodiment in FIG. 12 does not show the presence of the retraction protrusion 10 but ithe latter may be added.

In a fifth variant, the front link (here denoted 21') and its latch (here denoted 26') are secured together.

FIG. 15 illustrates in another way the embodiment in FIGS. 1, 2 and 3.

Figure 15A:
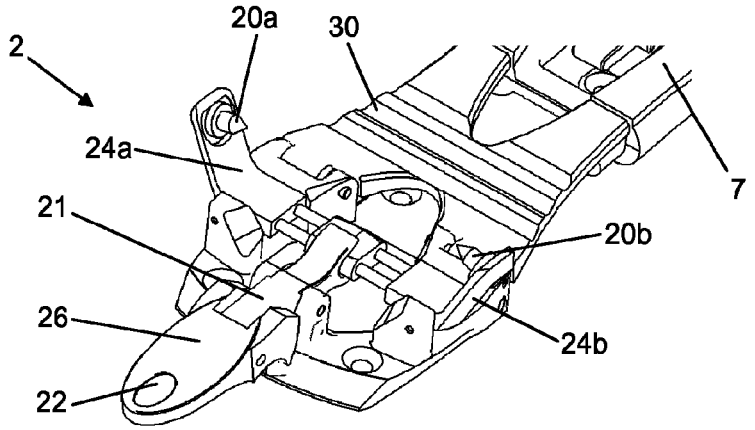
FIG. 15 shows a detail of the device shown in FIGS. 1 to 3, the functioning of which it illustrates.

FIG. 15*a* shows the binding in the open position, awaiting the boot. The clamps 24*a*, 24*b* are open and the front link 21 is in the top position.

Figure 15B:
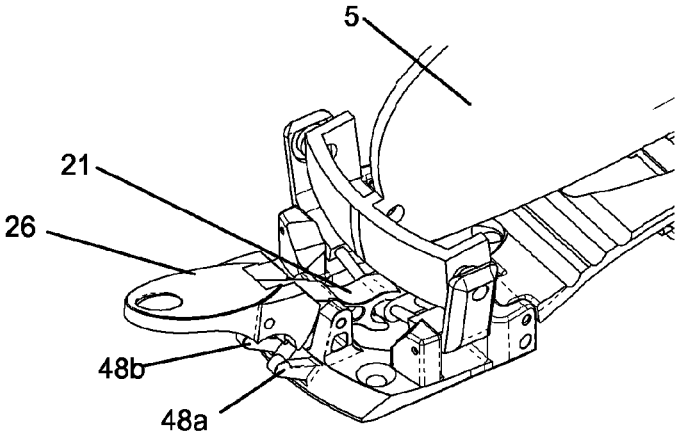

FIG. 15*b* shows the binding in the "boot in forward engagement" position; this is the Telemark position. The front link 21 has tilted downwards; the latch 26 has followed the tilting of the front link 21 (these two parts being connected by a pivot and a position-locking system) caused by the engagement of tip of the boot.

Figure 15C:
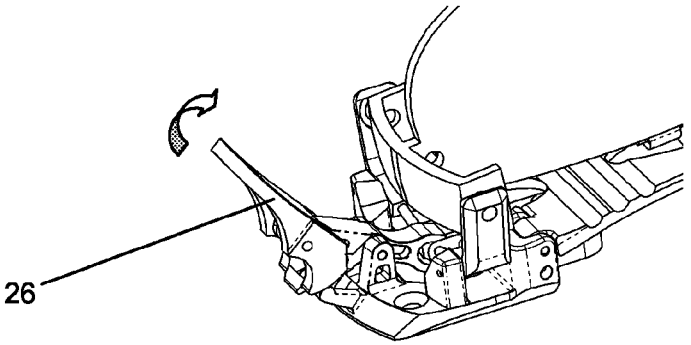

FIG. 15*c* shows the binding in the "touring" position. The latch 26 had been tilted by the skier by hand (typically by a pressure of the tip of the pole on a hollow zone 22 of the latch 26) and bears on at least one support protuberance 48 (here: two support protuberances 48*a*, 48*b*. The binding is locked and the skier can no longer remove the skis in this position).

FIG. 16 illustrates in a different way the embodiment in FIGS. 12, 13 and 14.

FIG. 16*a* shows the front retaining element 2 of the binding in the open position, awaiting the boot. This Figure includes the embodiment in which the front link 21' and its latch 26' are secured together (referred to in the following description as "part 21'+26").

FIG. 16*b* shows the binding in the "Telemark" position. The part 21'+26' has tilted downwards with the support surfaces 78*a*, 78*b* of the clamps 24*a*, 24*b*. The part 49 has not moved; it is independent of the part 21'+26'. In this configuration of the binding the skier can remove the skis.

FIG. 16*c* shows the binding in the "touring" position. The part 49 has been tilted by the skier, typically by vertical downward pressure exerted by the tip of his pole. The binding is locked and the skier can no longer remove the skis.

FIG. 16*d* shows in more detail the movement of the part 49 and of the slide 49: the lowering of the part 49 causes the retraction of the slide 47 in the direction of the arrow. A support surface 80 of the front link 26' locks the part 21'–26'. When the slide 47 has slid towards the rear, the part 49 is free to pivot upwards. The pivot point for the "Telemark" mode is close to the clamping point of the boot, and the boot can therefore pivot while greatly limiting the tension of the springs: when the skier lifts his heel, the boot pivots and makes a movement in an arc of a circle. The rear retaining element 3 also pivots about a pivot point and thus makes a movement in an arc of a circle. In Telemark mode (part 49 locked on the ski) this pivot point is distant from the front retaining element 2; this distance causes a high tension in the tensioning element 35 and makes the boot bend. The two arcs of a circle described by the movements of these two elements are distant from each other, and the tensioning element 35 compensates for the distance and thus increases the tension. In "tourist skiing" mode (part 49 released) the pivot point of the rear retaining element 3 is very close to the front retaining element 2 since the part 49 pivots with the rear retaining element 3 (see FIG. 13). The tension on the boot is lower and the skier can easily lift his heel for tourist skiing.

This variant of the front fixing element 2 therefore allows easy passage from "Telemark" mode to "touring" mode and vice versa without removing the boot, by means of a simple action by the tip of the pole on the element 49.

FIGS. 16*e* and 16*f* show more clearly the structure and the action of the slide 47 and of the "touring pivot assembly" part 49. FIG. 16*e* shows the part 49 in locked mode, FIG. 16*f* shows the part 49 released, after the slide 47 has released it; in this example, the slide cooperates for this purpose with a recess 81 provided in the part 49. The latter can pivot about an axis 82.

In FIGS. 1 to 10, 11*b*, 12 to 14 and 16, screws 17 for fixing the various elements on the ski appear, but the ski 28 is shown only in FIG. 11*a*.

The boot 5 has been described here as comprising a front sole 11 and a rear sole 13, these two parts being separated by the projection 46. In the context of the present invention, the projection 46 may also be produced in the form of a channel or any other hollow provided in the sole of the boot, in which case the protection 46 is, in the context of the description, said to belong to the front sole 11, the edge of the rear part 15 of which it represents; the rear sole 13 is in this case represented by the part of the sole that extends from the projection 46 as far as the rear end of the sole (referred to as the heel 12).

Figure 17:
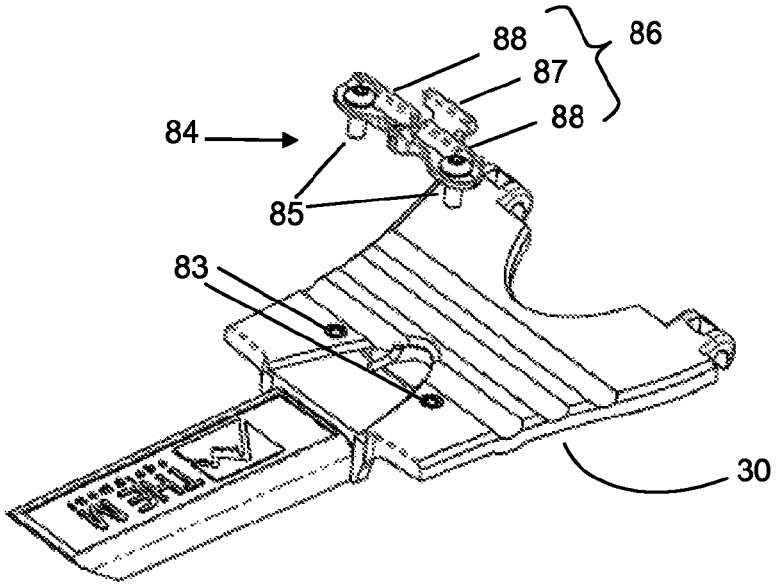
FIGS. 17 and 18 are perspective views illustrating a mounting member for blades, respectively in exploded view and in the mounted position.
Figure 18:
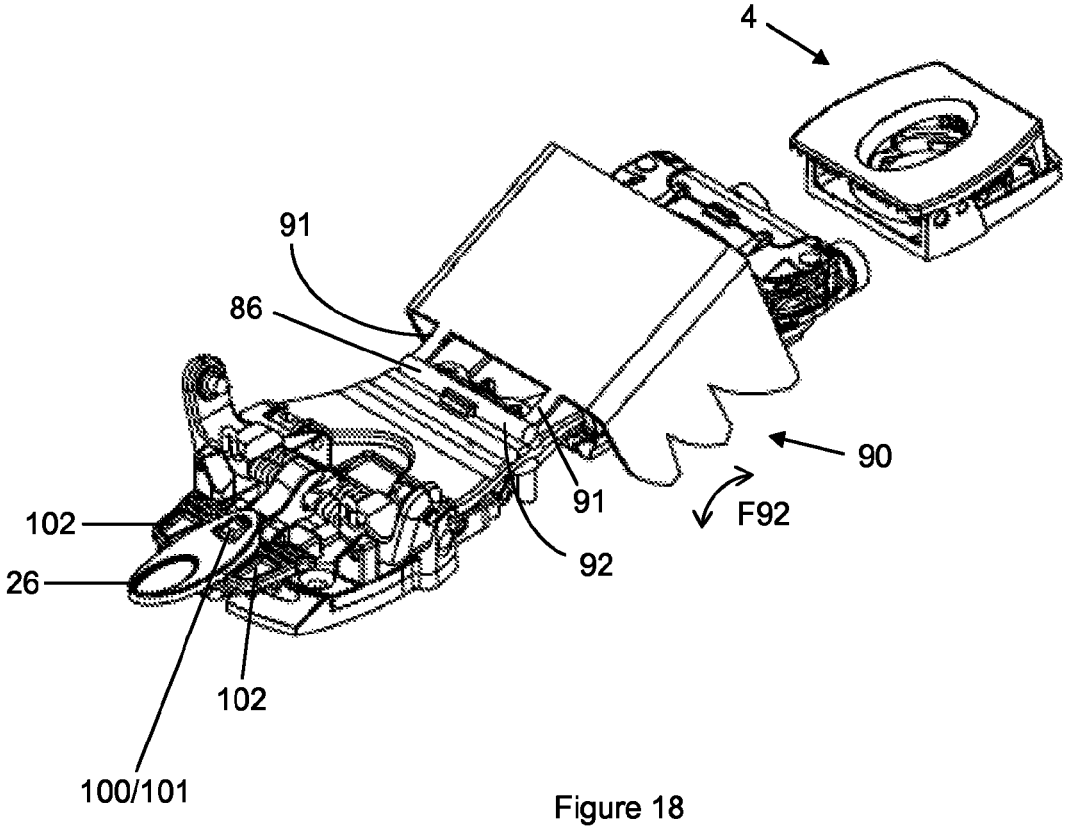

FIGS. 17 and 18 illustrate an additional embodiment of the invention, in which the flexible connecting element 30 has in it two orifices 83, intended for cooperation with a mounting member for blades. More precisely, this mounting member 84 has two fingers 85 intended to enter the aforementioned orifices 83, said fingers being able to cooperate with locking means, not shown, of any suitable type.

The member 84 further comprises a mounting housing 86 delimited by three protrusions, namely a first middle protrusion 87, facing two lateral protrusions 88. The opposite faces of these protrusions have a rounded surface, whereas these protrusions are advantageously produced from a material having a certain elasticity. The mounting zone 86 can therefore accept, removably, blades 90 such as those sold by the name Dynafit®. For this purpose, these blades are connected, via tabs 91, to a transverse rod 92 able to be received in the housing 86.

When the user has to follow a tricky passage, in particular on a glacier, he inserts the rod 92 in the housing 86, in particular by lateral sliding. The blades can then pivot with respect to the flexible element, about the axis of the transverse rod 92, in the direction of the arrow F92. The user next engages his boot in the front retaining element 2, as described above, so that the blades cannot become disconnected in an unwanted fashion. If he wishes to remove these blades, the user first of all disengages his boot from the front retaining element and then extracts the rod 92 out of the housing 86.

Figure 19:
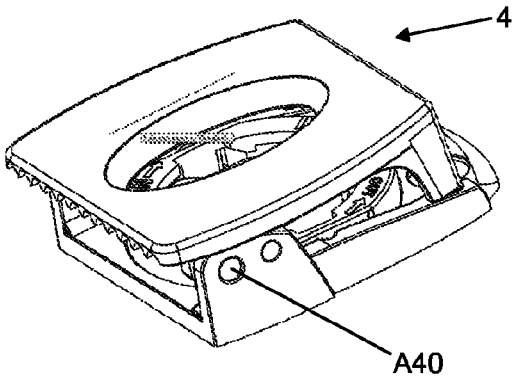
FIGS. 19 and 20 are perspective views illustrating a heel block equipping the binding, in the respectively lowered and raised positions.
Figure 20:
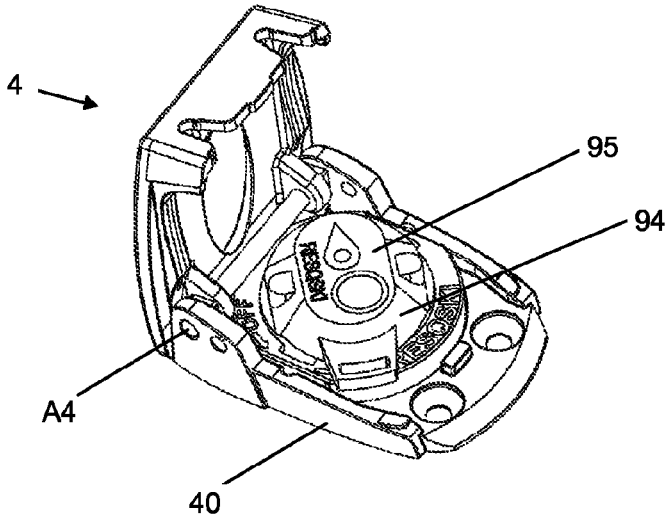

FIGS. 19 and 20 illustrate yet another additional embodiment of the invention, in which the heel block 4 is mounted so as to be able to move with respect to the support 40, in this case mounted so as to pivot about a transverse axis A4. In addition, the support delimits a housing 94, allowing reception of a sensor 95, of a type known per se. This sensor enables the user to find his ski after a fall, when the ski is in particular lost in powdery snow. This sensor is, by way of example, in accordance with the one sold under the name ResQski®.

Before engaging his boot in the front retaining element 2, the user pivots the heel block upwards about the axis A4, so as to access the housing 94. He next inserts the sensor in said housing: advantageously, the latter has walls suitable for removable fixing of the sensor 95, in particular by lateral sliding. It will be noted that this embodiment makes it possible to take advantage judiciously of the free space formed by the heel block. In addition, the top surface of this heel block protects the sensor 95 vis-á-vis any attack, in particular an unexpected blow from an edge. After use, the user disengages his boot from the front retaining element and then extracts the sensor 95 out of its housing 94.

Figure 21:
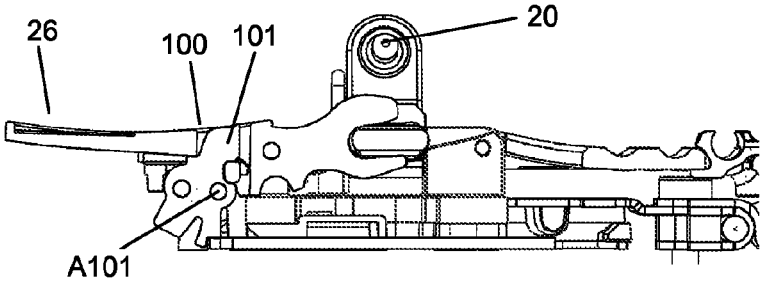
FIGS. 21 and 22 are perspective views illustrating a locking link equipping the binding, in the respectively neutral and locking positions.
Figure 22:
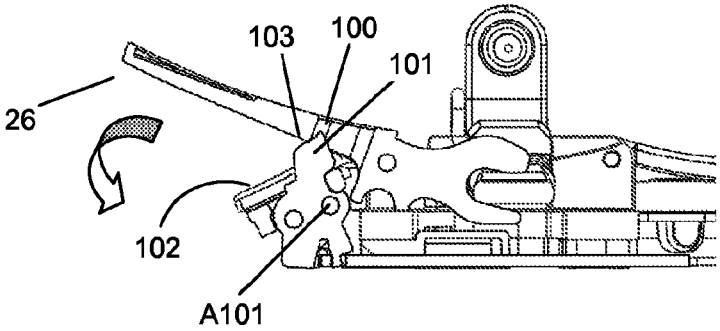

FIGS. 21 and 22 illustrate yet another additional embodiment of the invention in which the control latch 26 is hollowed out with a recess 100 emerging on both opposite faces. It is moreover provided with an additional link 101, referred to as a locking link, which is mounted so as to pivot about an axis A101, with respect the body of the front retaining element 2. The pivoting of this link 101 can be achieved by pressing on an actuation member 102 (see also FIG. 18) situated on either side of the latch 26. This pressing can be initiated for example by a pole and, because of this, the actuation member is advantageously provided with two hollows, providing easy cooperation with this pole.

The link is able to move between two functional positions. In the first position, illustrated in FIG. 21, this link is turned towards the rear of the ski, so that it does not interfere with the free tilting of the latch 26. In this first position, the user can therefore freely engage and disengage the boot with respect to the front retaining element.

In the second position, referred to as the locking position, illustrated in FIG. 22, this link is turned towards the front of the ski, so that it now prevents the free tilting of the latch 26. Advantageously, the user engages his boot in the first position of the link and then tilts this link into its second position. He can then no longer, when he does not intend to, disengage his boot with respect to the front retaining element. This is because the walls of the recess 100 then come into abutment against a so-called zone 103, belonging to the link 101. The ski can therefore no longer be released, which is particularly suited to a "touring" mode, so that the ski does not escape in particular in the case of lateral pressing on the ice.

In another embodiment, not illustrated by Figures, it is the heel 12 that is engaged by the rear fixing element 7.

The binding according to the invention has numerous advantages. It can be engaged and disengaged without the skier needing to bend down. In addition it is versatile, robust, reliable and lightweight.

LIST OF REFERENCE SYMBOLS

1 Binding
2 Front retaining element
3 Rear retaining element
4 Heel block
5 Boot
6 Tensioning link
7 Rear retaining stirrup
8 Rear attachment clamp
9 Knurled ring (9*a*, 9*b*)
10 Retraction protrusion
11 Front sole of the boot 5
12 Heel of the boot 5
13 Rear sole of the boot 5
14 Front part of the front sole 11
15 Rear part of the front sole 11
16 Retraction stop
17 Screw for fixing on the ski
18 Spring of the tensioning link 6
19 Spindle of the tensioning link 6
20 Lug (20*a*, 20*b*)
21 Front link
22 Hollow zone of the latch 26
23 Hollow insert
24 Clamp
25 Clip holding the link spindle 19
26 Latch of the front link 21
27 Plate of the front retaining element
28 Ski
29 Guide
30 Flexible connecting element
31 Elastic return element (spring)
32 Rod
33 Cable
34 Element for adjusting the pivot tip
35 Tensioning element
36 Tongue of the tensioning link 6
37 Spindles of the connecting element 30
38 Lateral stop
39 Spindle of the lateral stop 38
40 Heel-block support
41 Support surface of the heel block
42 Tilting button
43 Top chock
44 Heel-block spindle
45 Touring locking latch
46 Rear projection of the front sole 11
47 Slide
48 Support protuberance
49 Touring-mode control latch
50 Touring-pivot assembly
70 Safety spring
71 Adjustment screw (tension of the spring 70)
72 Tension indictor
73 Slide
74 Front end of the link 6
75 Groove of the connecting element 30
76 Base (plate)
77 Arch
78 Support surface of the clamp 24
80 Support surface of the front link
81 Recess in the assembly 49
82 Pivot point of the assembly 49
83 Orifices of the element 30
84 Mounting member
85 Fingers of the member 84
86 Mounting housing
87 Middle protrusion
88 Lateral protrusions
90 Blades
91 Tabs of the blades 90
92 Rod of the blades 90
94 Housing of the support 40
95 Sensor
100 Recess in latch 26
101 Link
102 Member actuating 101
103 Locking zone of 101

What is claimed is:

1. A ski binding to fix a ski to a ski boot having a front sole and a heel, the ski binding comprising:

a front retaining element configured to cooperate with the front sole of the ski boot;

a rear retaining element configured to cooperate with a projection on a rear part of the front sole and/or with a rear sole of the ski boot and pivot in a vertical plane about a horizontal axis orthogonal to a direction of the ski, between an upper or idle position, and a lower or engaged position;

a tensioning element configured to act between the rear retaining element and the ski and/or the front retaining element to tension the ski boot on the ski binding and also enable the heel of the ski boot to be freely lifted;

a tensioning link configured for placement under and connected to a rear retaining stirrup of the rear retaining element, and also configured to enable pivoting of the rear retaining stirrup in a vertical plane about a horizontal axis orthogonal to the direction of the ski; and a retraction stop configured for placement on the ski or the front retaining element to cooperate with the tensioning link and abut thereon in a removeable manner at a point located in front of a pivot axis that connects the tensioning link and the rear retaining stirrup, in a direction of movement of the ski, to enable the rear retaining stirrup to move rearwardly and thereby tension the tensioning element when the heel of the ski boot exerts a downwardly directed pressure on the rear retaining stirrup situated in the idle position.

2. The ski binding of claim 1, wherein a rear part of said rear retaining stirrup is connected to a rear part of said tensioning link.

3. The ski binding of claim 1, wherein said tensioning link, when the rear retaining element is engaged, abuts against said retraction stop with a front end thereof.

4. The ski binding of claim 1, wherein, when the rear retaining stirrup is released from a retraction tension and when the projection of the rear part of the front sole, or the heel of the ski boot, is inserted in the rear retaining stirrup, the projection or the heel of the ski boot bears on a tongue of the tensioning link, and locks said tensioning link in the retracted position.

5. The ski binding of claim 1, wherein, when the ski boot is received in the rear retaining element, after locking of the front retaining element on the front part of the front sole and the heel is lowered, the rear sole bears directly or indirectly on the rear retaining stirrup, and imposes a retraction of the rear retaining stirrup under the effect of the tensioning link, which is in abutment on the fixed retraction stop, so that the retraction of the rear retaining stirrup enables the projection or heel of the ski boot to be inserted in the rear retaining stirrup.

6. The ski binding of claim 1, wherein the rear retaining element comprises a retraction protrusion arranged at a rear of the fixed stop, or integrated in the tensioning link, and which is configured to release the tensioning link from its abutment on the retraction stop when the projection or the heel of the ski boot is inserted in the rear retaining stirrup.

7. The ski binding of claim 1, wherein said tensioning element comprises:

elastic return members disposed on either side of the rear retaining element and inside the rear retaining stirrup;

at least one ring to adjust a preloading of the tensioning element; and a set of rods and cables that cooperate with said elastic return members to tension the retaining stirrup.

8. The ski binding of claim 1, further comprising a control element including a latch that, when actuated, enables the rear retaining stirrup to be held in a retracted position to prevent the projection or heel of the ski boot from being hooked by the rear retaining stirrup, by acting directly on the rear retaining stirrup or the tensioning link.

9. The ski binding of claim 1, wherein said rear retaining stirrup comprises lateral stops, disposed on either side of a rear part thereof, to center the rear projection of the front sole of the ski boot on said rear retaining stirrup, said lateral stops being disposed so as to enable each to pivot about a vertical axis under effect of a torque generated by a lateral movement of the ski boot when the ski is removed.

10. The ski binding of claim 1, further comprising a spindle to connect the tensioning link to the tensioning element or the rear retaining stirrup, wherein the spindle is situated in a plane of said tensioning element, enabling the rear retaining stirrup to slide parallel to the plane of said tensioning element.

11. The ski binding of claim 1, wherein the tensioning link is to contact the retraction stop at a bearing point situated in front of a connection point between the tensioning link and the retaining stirrup, in reference to a direction of movement of the ski.

12. The ski binding of claim 1, wherein the tensioning link is mounted so as to pivot on the rear retaining stirrup about the pivot axis orthogonal to the direction of the ski.

13. The ski binding of claim 12, wherein the tensioning link is to contact the retraction stop at a point situated in front of said pivot axis of the tensioning link, in reference to the direction of movement of the ski.

14. The ski binding of claim 1, wherein the rear retaining element comprises a front part that is free to pivot with respect to the front retaining element about a transverse axis, while being translationally connected with respect to the front retaining element, the rear retaining stirrup having a degree of freedom in translation with respect to the front part along the longitudinal axis of the ski.

15. The ski binding of claim 1, wherein the rear retaining element comprises a removable fixing device to remove fixing of blades which are to pivot with respect to the rear retaining element about a transverse axis.

16. The ski binding of claim 15, wherein the removable fixing device comprises a fixing member to delimit a housing, configured to receive, by lateral sliding, a pivoting rod secured to said blades.

17. The ski binding of claim 1, further comprising:

a heel block;

a support upon which the heel-block is moveably mounted;

a support housing for the support; and a sensor received in the housing.

18. The ski binding of claim 17, wherein the heel block is moveably mounted so to move between an access position to allow access to the support housing for receipt of the sensor, and a covering position which prevents access to this housing while protecting the sensor.

19. The ski binding of claim 1, further comprising:

a control element to control the front retaining element; and a locking member to lock the control element, and which is to move between a neutral position in which the locking member does not interfere with movement of the control element, and a locking position in which the locking member prevents movement of the control element in order to prevent unwanted disengagement of the ski boot with respect to the front retaining element.

20. The ski binding of claim 19, wherein the locking member is configured to extend through a recess in the control element, and includes a locking zone to come into abutment against the walls of the recess in the locking position.

* * * * *